US007061430B2

(12) United States Patent
Zheng et al.

(10) Patent No.: US 7,061,430 B2
(45) Date of Patent: Jun. 13, 2006

(54) ANTENNA

(75) Inventors: Ming Zheng, Farnborough (GB); Hugh Shapter, Richmond (GB)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/180,122

(22) Filed: Jun. 27, 2002

(65) Prior Publication Data

US 2003/0016175 A1 Jan. 23, 2003

(30) Foreign Application Priority Data

Jun. 29, 2001 (GB) ..... 0116001.9

(51) Int. Cl.
*H01Q 1/38* (2006.01)

(52) U.S. Cl. ..... 343/700 MS; 343/702; 343/834; 343/846

(58) Field of Classification Search ..... 343/702, 343/700 MS, 833, 834, 846
See application file for complete search history.

(56) References Cited

U.S. PATENT DOCUMENTS 5,585,807 A * 12/1996 Takei ..... 343/702
5,760,745 A 6/1998 Endo et al.
5,966,097 A 10/1999 Fukasawa et al.
6,225,951 B1 * 5/2001 Holshouser et al. . 343/700 MS

FOREIGN PATENT DOCUMENTS

| | | |
|---|---|---|
| EP | 0 923 158 A2 | 6/1999 |
| EP | 1 102 347 A2 | 5/2001 |
| GB | 1 526 505 | 9/1978 |
| WO | WO 99/63616 | 12/1999 |

OTHER PUBLICATIONS

European Search Report.
Sakai, S, et al: "Directivity Gain Enhancement of Small Antenna by Parasitic Patch", Antennas and Propagation Society International Symposium, 1998, IEEE Atlanta, Ga., USA Jun. 21-26, 1998, New York, NY, USA, IEEE, US, Jun. 21, 1998, pp. 320-323, XP010291893, ISBN: 0-7803-4478-2.

* cited by examiner

*Primary Examiner*—Michael C. Wimer
(74) *Attorney, Agent, or Firm*—Alston & Bird LLP

(57) ABSTRACT

An antenna is disclosed. The antenna has a first element including an unbalanced antenna with a feed point, and a second element. The second element has a spaced relationship with the first element, and includes a balanced antenna arranged to be electromagnetically coupled to the first element. Embodiments of the invention exhibit relatively high Pattern Averaged Gain (PAG).

31 Claims, 4 Drawing Sheets

1920 MHz
1980 MHz
2110 MHz
2170 MHz

1920 MHz
1980 MHz
2110 MHz
2170 MHz

ANTENNA

BACKGROUND OF THE INVENTION

This invention relates to an antenna. The antenna has a relatively high Pattern Averaged Gain (PAG) figure, and finds particular utility in portable wireless devices such as portable telephones.

PAG is one of several metrics that can be used to characterise antennas. All antennas radiate energy, to a greater or lesser degree, in one or more directions. PAG is one measure of the average transmission characteristics averaged over a full 360° surrounding the antenna. The better the PAG figure, the better the overall transfer of energy from the transmitter via the antenna.

PAG is normally calculated to take into account the dominant polarization intended for a given antenna. For instance, in mobile telephony, the antenna at a Base Station (BS) is generally vertically polarized, and in order to optimize performance, the antenna at the Mobile Station (MS) should be vertically polarized also. However, different people hold their MSs differently, and the relative polarization can differ depending on exactly what position the telephone is held in and whether the MS is held in the left or right hand.

To facilitate comparison between different antennas, during empirical measurements, the MS is arranged so that it is positioned next to a dummy head (to mimic the user's head), and inclined at 60° to the vertical. All PAG measurements and comparisons referred to in this specification were made in this way.

Portable telephones communicate with remote base stations via signals transmitted and received from one or more antennas forming part of the Radio Frequency (RF) circuitry of the telephone. Prior art telephones use a wide variety of different types of antenna depending on a number of factors including size of telephone, cost, performance and bandwidth.

Older portable telephones, and some new ones, use retractable or telescopic whip antennas almost exclusively. Later telephones typically use helical stub antennas or internal planar antennas.

A problem with prior art antennas is their relatively low PAG figures. This effectively means that for a given amount of power input to the antenna, a relatively low power signal is emitted from the antenna (when compared to embodiments of the invention).

The transmitter accounts for the bulk of the power consumed by a portable telephone. For this reason, manufacturers often quote several figures for battery life, depending on what proportion of the time the telephone is transmitting rather than being in a standby mode waiting for a call to be made or received. It is clear from such figures what impact transmission can have on battery life, and hence talk time.

Improvements in PAG for a given telephone by use of a different antenna can therefore have a direct measurable effect on talk time and battery life. Improved PAG can also improve call quality, particularly in areas of poor reception, as the benefits of PAG apply equally well to reception as well as transmission.

SUMMARY OF THE INVENTION

According to a first aspect of the present invention there is provided an antenna comprising: a first element comprising an unbalanced antenna having a feed point; and a second element, having a spaced relationship with the first element, and comprising a balanced antenna arranged to be electromagnetically coupled to the first element such that the field distributions of each are substantially aligned for efficient coupling.

An antenna according to embodiments of the invention has a higher PAG figure than an antenna consisting of only one of the two elements making up the antenna. A higher PAG contributes directly to longer talk time/battery life, as less power needs to be transmitted from the antenna to achieve a desired signal strength at a given remote point.

Such performance also means that such an antenna, operating in receive mode, is better able to receive signals of a given strength, than an antenna having a lower PAG figure.

The term 'feed point' when used in relation to embodiments of the invention is intended to refer to a common electrical connection used to transfer energy into and out of the antenna.

An antenna according to embodiments of the invention matches more closely the ideal of vertical polarization than some prior art internal antennas, particularly PIFAs. This has the advantage that the transfer of energy between the transmitter and receiver can be maximized.

An antenna according to embodiments of the invention can be used in handsets operable according to the WCDMA standard, which has a relatively wide separation between TX and RX bands. The wide bandwidth of operation of such an antenna ensures that the PAG figure can be maintained across the entire bandwidth of operation of the antenna.

Since the operational frequency used by devices operating according to the Bluetooth standard is relatively near to the operational frequencies of WCDMA, it may be possible to use such antennas for communication using Bluetooth.

Antennas according to embodiments of the invention comprise a directly driven unbalanced antenna and an electromagnetically coupled balanced antenna. Preferred embodiments use a PIFA as the unbalanced antenna, and a half wavelength microstrip or patch antenna for the balanced antenna. A half wavelength patch antenna is found to behave electrically as though it was a half wavelength dipole antenna.

Forms of antenna other than those specifically disclosed may also be suitable.

Antennas according to embodiments of the invention benefit from advantages such as the good impedance matching of unbalanced antennas, and good polarization characteristics of balanced antennas, without suffering from drawbacks such as the poor impedance matching of balanced antennas, and relatively high induced ground plane current of unbalanced antennas.

Advantageously, an antenna according to embodiments of the invention can be simply incorporated into a portable telephone, or other wireless communication device. In one embodiment, the antenna can be arranged to be co-planar, with both elements disposed on a common circuit board. In an alternative embodiment, one element can be disposed on a circuit board, and the other element can be disposed on an internal surface of a cover of the telephone. In this way, the spaced relationship between the two elements is achieved when the cover is attached to the telephone body during assembly of the telephone.

In a further embodiment, the two elements of the antenna may be disposed on opposing surfaces of the same Printed Circuit Board (PCB).

BRIEF DESCRIPTION OF THE DRAWINGS

For a better understanding of the present invention, and to understand how the same may be brought into effect, the invention will now be described, by way of example only, with reference to the appended drawings in which.

DETAILED DESCRIPTION OF THE INVENTION

Figure 1:
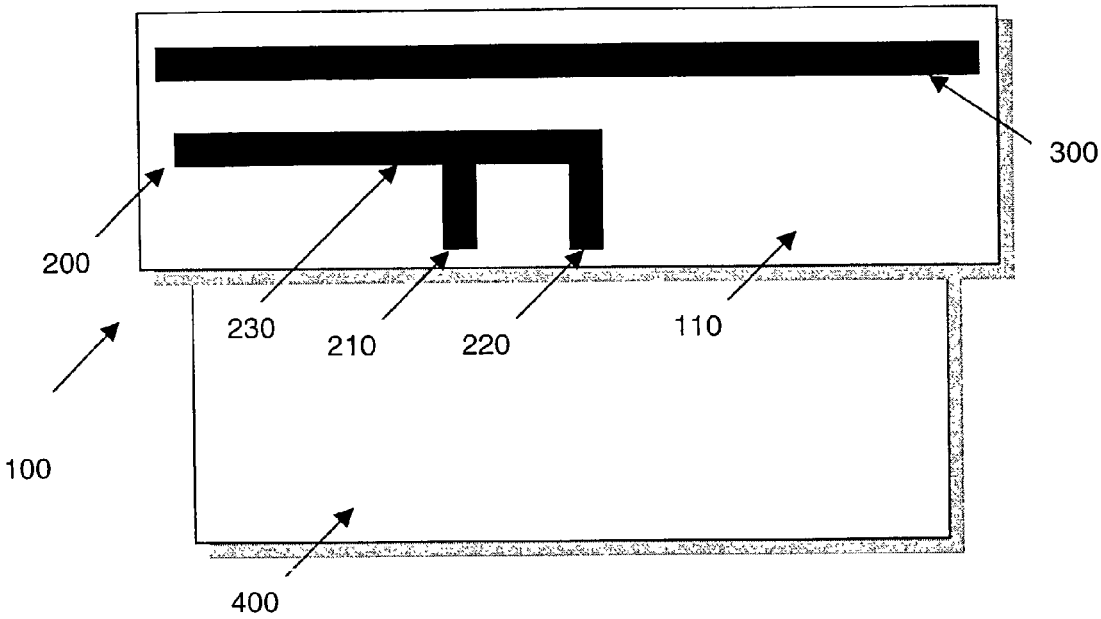
FIG. 1 shows a preferred embodiment of the invention.

FIG. 1 shows a plan view of an antenna 100 according to an embodiment of the invention. The antenna 100 is disposed on a substrate 110. The substrate comprises an insulating material. The antenna is positioned slightly above a ground plane 400. The ground plane is formed from a circuit board housing components of a portable telephone. The antenna 100 may be formed integrally with the ground plane 400.

The antenna 100 comprises two distinct antenna elements 200, 300 arranged to be coplanar. Elements 200 and 300 are created on the substrate using standard techniques. Such techniques may include printing using a suitable conductive ink, or deposition, or using a metal removing process such as etching.

Element 200 is a Planar Inverted F Antenna (PIFA). It is a conventional quarter wavelength ($\lambda/4$) PIFA and comprises a feed point 210, a ground stub connection 220 and a radiating portion 230. 'Quarter wavelength' refers to the wavelength of intended operation of the antenna, and so the PIFA is dimensioned in the usual way depending on its frequency of operation.

Positioned apart from the PIFA, and electrically insulated from it, is antenna element 300. Element 300 is a patch antenna, specifically a half wavelength ($\lambda/2$) patch antenna. One of the open ends of ($\lambda/2$) patch antenna is aligned with the open end of the PIFA for efficient coupling between them. This allows the field distributions including orientation to substantially align. The aligned fields may be electrical or magnetic or both.

The mode of operation of antenna 100, comprising elements 200 and 300 is different from the mode of operation of either of the elements individually. It is, however, instructive to examine the operation of elements 200 and 300 alone, and then consider their mutual interaction.

Figure 2:
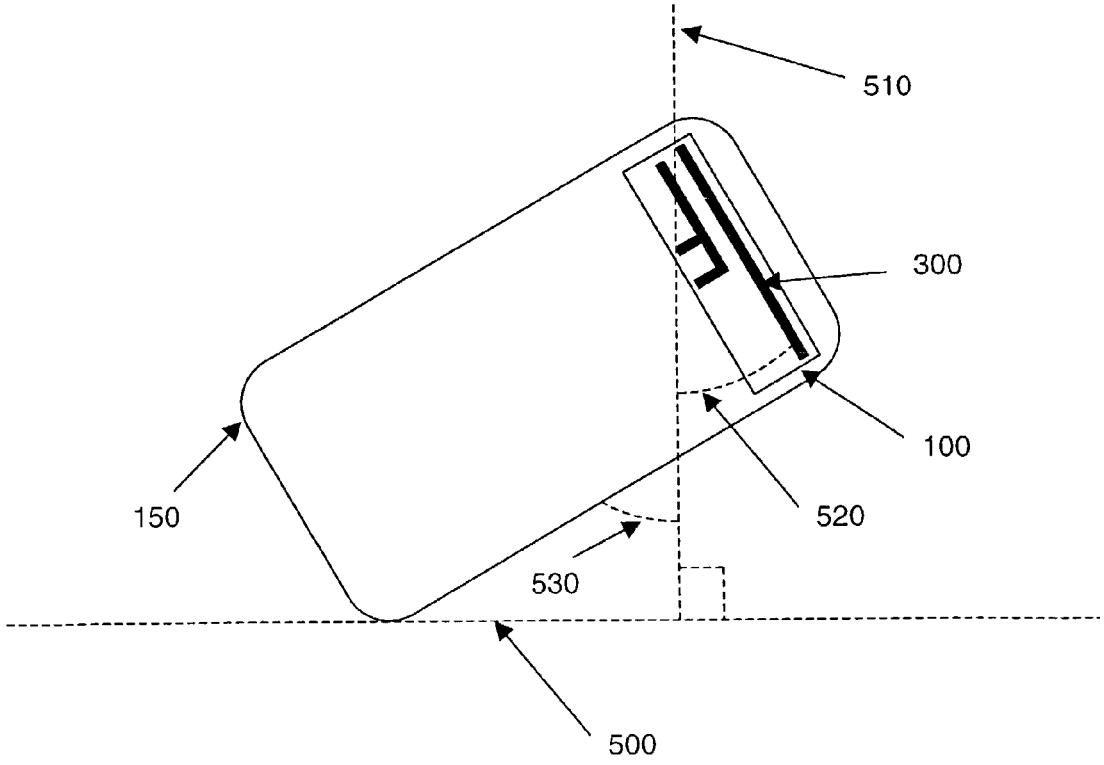
FIG. 2 shows the orientation of the antenna of FIG. 1 in use.

The polarization of the PIFA 200 is determined by the orientation of the radiating part 230. If the PIFA as shown were positioned horizontally inside a portable telephone then in use, the radiating part 230 would be positioned at an angle of 30° to the vertical, which helps to achieve the aim of near-vertical polarization. FIG. 2 illustrates this situation.

The PIFA 200 is an unbalanced antenna, which means that when transmitting, a relatively large current is induced in the ground plane 400. Experiments have shown that this current flows up the ground plane 400 in a direction parallel with the feed point 210 and ground stub 220. In effect, this current has a pronounced effect on the polarization of the antenna, as it accounts for a large proportion of the transmitted energy. A problem is that the direction of this current flow is shifted 90° from the desired polarization as defined by radiating element 230.

The current flowing in the ground plane 400 is easily influenced by external structures, such as the user's hand holding the telephone. Such external factors can de-tune the antenna, and adversely affect its performance.

PIFA antennas offer advantages in that they are compact, and offer good impedance matching characteristics, but being unbalanced, they can suffer from external influences, and it can be difficult to assess their exact polarization due to the current flow in the ground plane.

The patch element 300 is a simple linear construction having an electrical length of half a wavelength at the desired frequency of operation.

Element 300 is a balanced antenna. Balanced antennas do not induce current in a ground plane in the same way as described for the PIFA 200. However, balanced antennas are not widely used as internal antennas for portable telephones. This is, for example, because a patch antenna, behaving electrically as a dipole, in close proximity to a ground plane has a relatively low input impedance which makes it difficult to match to the standard 50 Ω impedance found throughout the RF portion of the telephone. Another reason is that a half wavelength microstrip patch antenna, which has better impedance characteristics, tends to be too large to incorporate into a portable telephone.

Due to the balanced nature of the patch 300, and the lack of induced current flow in the ground plane 400, the polarization is determined essentially by the direction of current flow in the antenna 300.

The above has described some of the advantages and disadvantages of balanced and unbalanced antennas, and explains a little of why certain types of antenna have been used in portable telephones.

The antenna 100, according to an embodiment of the invention, is able to benefit from some of the advantages of both types of antenna, while avoiding some of the drawbacks of each.

The PIFA 200 is directly electrically driven at the feed point 210 from the output of a transmitter in the RF section of a portable telephone. The ground stub portion is connected, directly or indirectly, to the ground plane 400.

The PIFA offers good impedance matching to the transmitter, and as such, the transfer of energy to the antenna 100 can be optimized. The PIFA is not intended to be the primary radiator of energy from the telephone. The primary purpose of the PIFA 200 in antenna 100 is to excite the patch element 300.

Patch element 300 is not electrically connected to the PIFA 200. It is driven electromagnetically, or parasitically, by the PIFA 200. In this way, the current induced in the patch element 300 flows along the length of the patch and this direction establishes the polarization of the antenna 100. As stated previously, the direction of current flow in the primary radiating element 300 relates directly to the polarization of the antenna.

As patch element 300 is the primary radiator of energy from the antenna, the problem of current flow in the ground plane is greatly mitigated. This leads to a reduced susceptibility to problems of detuning and energy loss caused by interaction with a user's hand, for instance. It also leads to a more defined and predictable polarization, as the impact of current flow in the ground plane on the angle of polarization is at least reduced.

The distance of the patch 300 from the PIFA 200 is close enough to ensure good coupling between the two elements. In experiments, a distance between the two elements of between λ/30 and λ/15 is found to give satisfactory performance. However, simple experimentation in each case will reveal the optimum separation. The space constraints imposed by placement in a portable telephone may well dictate the achievable separation.

Thus, when the portable telephone is held at a nominal 60° from the vertical, the patch element 300 is positioned at 30° from the vertical. This orientation approximates to true vertical polarization, at least for the purposes of comparative measurements.

This situation is pictured in FIG. 2. The telephone 150 includes antenna 100. The horizontal 500 and vertical 510 axes are shown for reference. The telephone 150 is oriented at an angle 530 of 60° to the vertical axis 510. In this position, which is deemed to represent a realistic orientation for a telephone in use, the antenna 100, and particularly element 300, are inclined at an angle 520 of 30° to the vertical axis 510.

In alternative embodiments of the invention, the two antenna elements can be disposed on different planes, rather than the single plane disclosed in FIG. 1. There are many ways of achieving a spaced relationship between the two antenna elements while maintaining a distance which enables the appropriate degree of electromagnetic coupling to occur. The physical constraints of a particular implementation will often dictate the optimum configuration.

In a particular embodiment, one antenna element, for example the PIFA 200, is disposed on a circuit board carrying components of the portable telephone, while the patch 300 is disposed on an inner surface of a cover of the telephone. In this way, when the telephone cover is attached to the body of the telephone, the two elements are positioned in a defined spaced relationship which ensures that the appropriate degree of coupling is achieved. As in the previous embodiment, there is no direct electrical connection between the two antenna elements.

In an alternative embodiment, the two elements of the antenna may be arranged on opposing sides of the same printed circuit board (PCB). There is generally more free space on one side of a PCB than the other, and this approach may optimize use of that space.

In alternative embodiments, the patch element may be configured in different ways. A person of skill will be aware of different configurations for patch antennas. An example of a suitable patch antenna has a resonant frequency defined by the length of one side of a square or rectangle of conductive material.

A particular application for antennas according to embodiments of the invention is for use in portable telephone handsets operable according to the Wideband Code Division Multiple Access (WCDMA) standard. This standard defines transmit (TX) and receive (RX) bands running from 1920–1980 MHz and 2110–2170 MHz respectively. The relatively wide separation between the TX and RX bands makes it difficult to provide an antenna that has both a wide enough impedance bandwidth and sufficiently high PAG.

Prior art antennas suitable for such operation generally compromise the PAG performance in order to operate over the required bandwidth.

Figure 3:
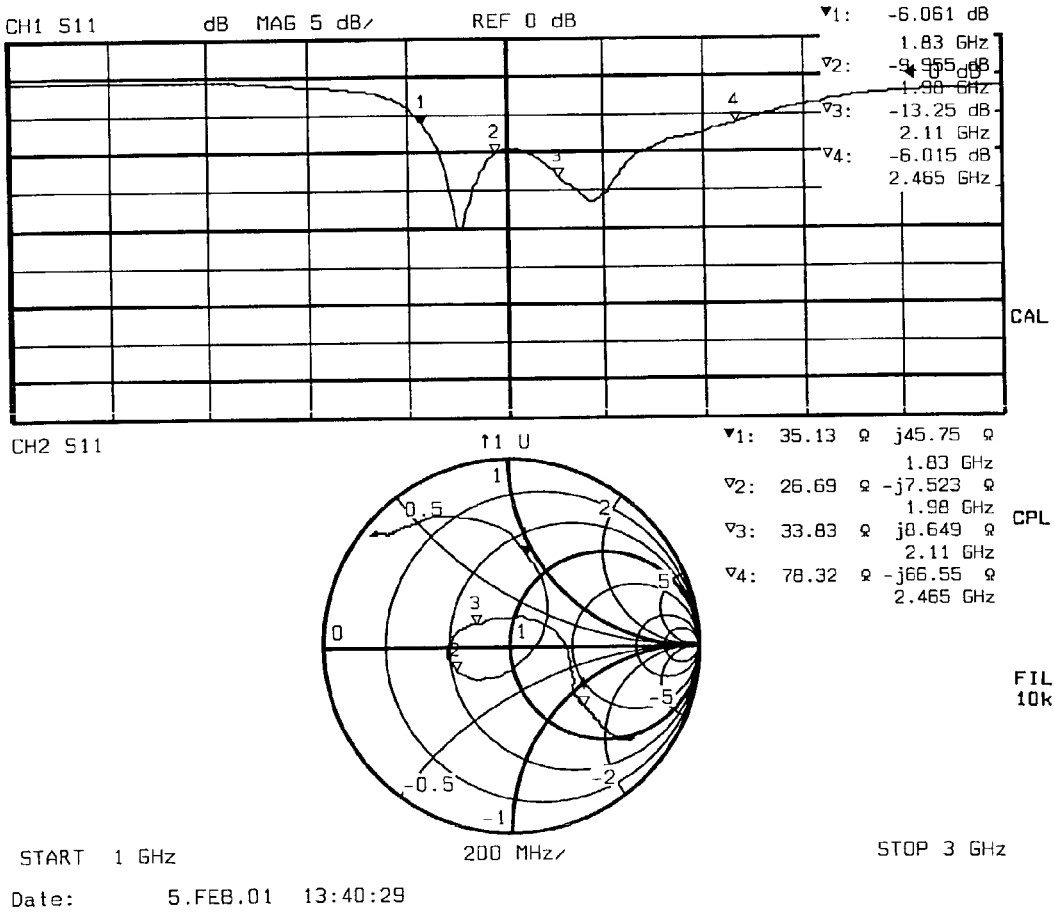
FIG. 3 shows a frequency response plot and a Smith chart for the antenna of FIG. 1.

FIG. 3 shows a frequency response plot and associated Smith chart recorded for an antenna according to an embodiment of the invention. The frequency response plot shows two distinct peaks in the performance, and a useful bandwidth running from 1830 MHz to 2465 MHz, which is more than adequate for use with the TX and RX bands of WCDMA.

The antenna characterized by the data of FIG. 3 also operates at a frequency making it operable according to the Bluetooth communication standard.

The Smith chart of FIG. 3 shows the characteristic loop of a broadband antenna around the center point of the chart.

Figure 4:
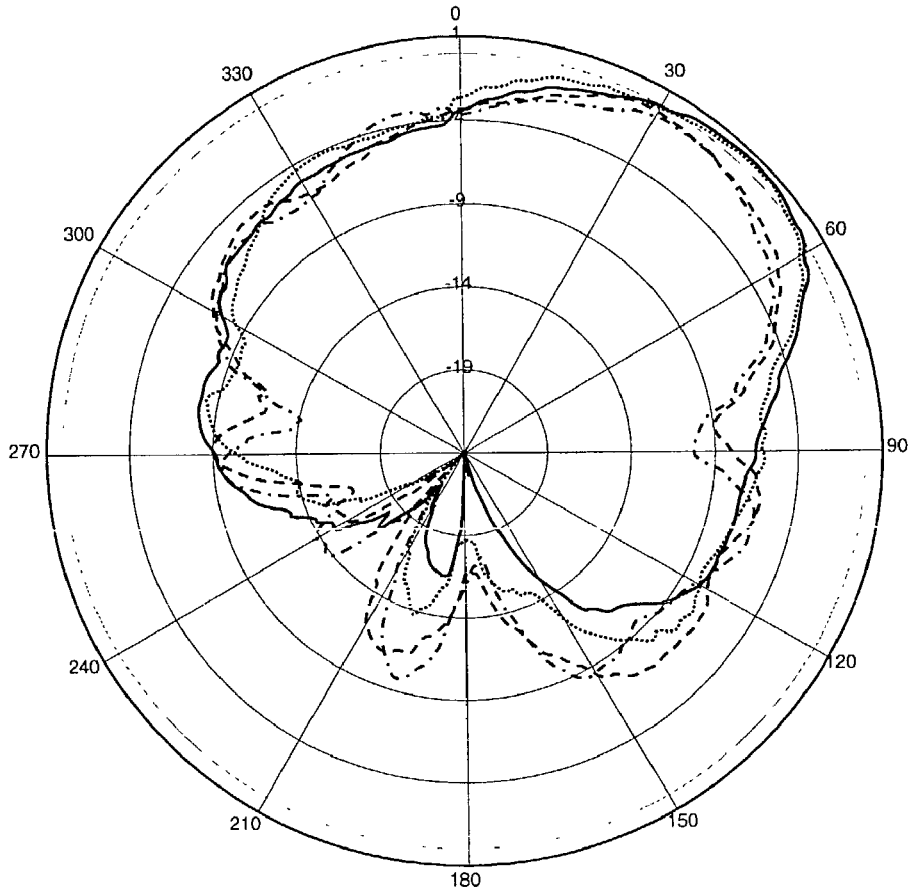
FIG. 4 shows the measured radiation pattern (vertical polarization) of an antenna according to an embodiment of the invention using a standard artificial head.
Figure 5:
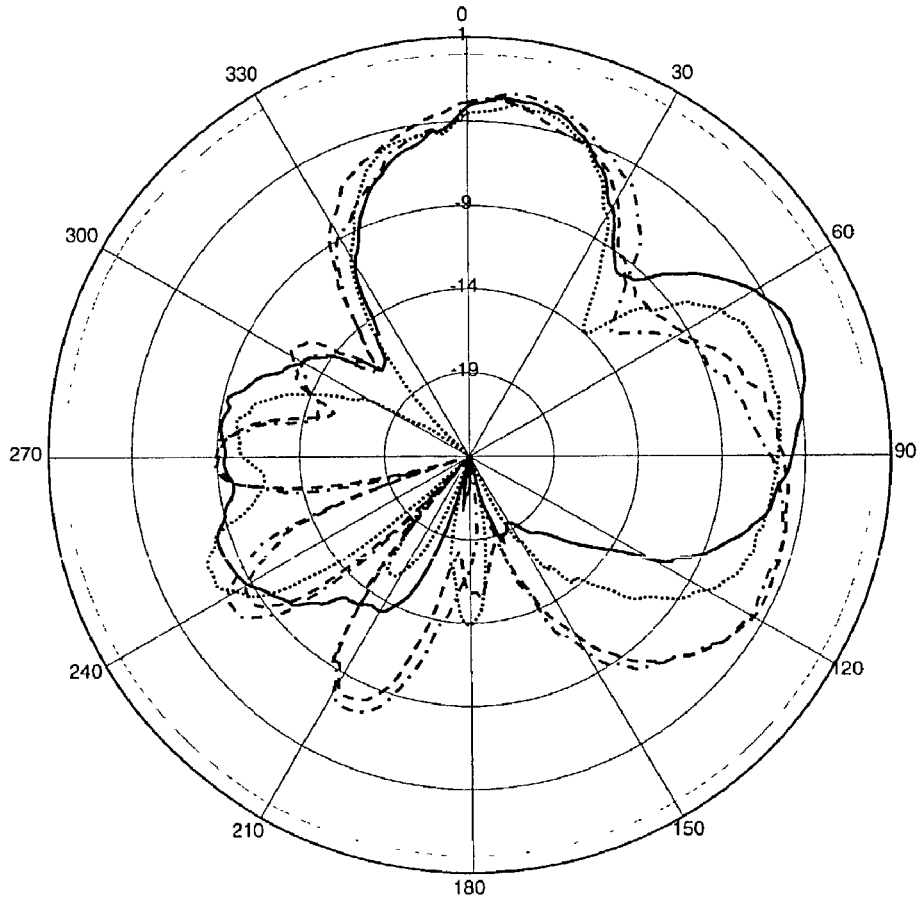
FIG. 5 shows the measured radiation pattern (horizontal polarization) of an antenna according to an embodiment of the invention using a standard artificial head.

FIGS. 4 and 5 illustrate test measurements taken for vertical and horizontal polarization respectively using a test phone incorporating an antenna according to an embodiment of the invention. The plots show measurements taken at the extremes of the frequency bands of WCDMA.

The plots show a better performance for vertical polarization, which is the desired result. As base station antennas are generally vertically polarized, this is the preferred mode of operation of antennas in portable devices.

The table below shows typical measured PAG values for various antenna types measured using the test setup as illustrated in FIG. 2 together with an artificial head. The values for an antenna according to an embodiment of the invention are derived from FIGS. 4 and 5.

| | Pattern Averaged Gain (PAG) (dBi) | | | | |
|---|---|---|---|---|---|
| Antenna type | 1920 MHz | 1980 MHz | 2110 MHz | 2170 MHz | Average |
| Antenna pictured in FIG. 1 | −3.27 | −2.92 | −2.92 | −2.97 | −3.02 |
| PIFA | −7.45 | −6.60 | −5.89 | −6.57 | −6.63 |
| Extended whip | −4.30 | −5.10 | −4.20 | −4.60 | −4.55 |
| Helical Antenna | −6.10 | −5.30 | −4.20 | −4.50 | −5.05 |

For each test, the phone was placed in the same position—running from ear to mouth and touching the cheek at the center.

The table gives PAG figures in dBi, i.e. dB relative to an ideal isotropic radiator. As such, the higher (less negative) the PAG figure is, the better. The PAG figures are given at the extremes of the TX and RX bands for WCDMA, and then the final column gives an average of all the figures.

From a comparison of the figures, it can be seen that an antenna according to an embodiment of the invention offers typical improvements in PAG of 3.6 dB when compared to a PIFA, 1.5 dB compared to a whip antenna, and 2 dB compared to a helical antenna.

An improvement of 3 dB in PAG equates to twice as much power being received at a given distance from the transmitting antenna. The corollary of this means that to ensure that a given power level is received at a given point, only half as much power needs to be transmitted in the first instance. Such a saving in transmission power has a noticeable effect on battery life, and hence the talk time available to the user from a given battery.

In the context of the present invention, any reference to transmission from the antenna is also intended to include, where appropriate, reception by the antenna. This is due to the inherent reciprocity of antennas.

The present invention includes any novel feature or combination of features disclosed herein either explicitly or any generalization thereof irrespective of whether or not it relates to the claimed invention or mitigates any or all of the problems addressed.

The invention claimed is:

1. An antenna comprising:

a first unbalanced antenna element having a first length in a first direction, a feed point and a first part at which the electric field produced by the first unbalanced antenna element is a maximum and a second part at which the electric field produced by the first unbalanced antenna element is a minimum;

a second balanced antenna element having a second length in the first direction, a spaced relationship with the first unbalanced antenna element and a first part at which the electric field produced by the second balanced antenna element is a maximum and a second part at which the electric field produced by the second balanced antenna element is a minimum wherein the first and second parts of the first unbalanced antenna element and the first and second parts of the second balanced antenna element lie within the same plane wherein:

a maximum amplitude of an electric field produced by the first unbalanced antenna element and a maximum amplitude of an electric field produced by the second balanced antenna element are in line with a second direction that is substantially perpendicular to the first direction.

2. An antenna as claimed in claim 1, wherein the first unbalanced antenna element comprises a first end, which is an open circuit, at one extremity of the first length and a second end, which is grounded, at another extremity of the first length, the second balanced antenna element comprises a first end, which is an open circuit, at one extremity of the second length and a second end, which is an open circuit, at another extremity of the second length and wherein the first end of the first element and the first end of the second element are substantially in line with the second direction that is substantially perpendicular to the first direction.

3. An antenna as claimed in claim 2, wherein a maximum amplitude of an electric field is produced by the first unbalanced antenna element at a first end thereof and the maximum amplitude of an electric field is produced by the second balanced antenna element at a first end thereof and at a second end thereof.

4. An antenna as claimed in claim 1, wherein the first length corresponds to $\lambda/4$ at resonant frequency and the second length corresponds to $\lambda/2$ at resonant frequency.

5. An antenna as claimed in claim 1, wherein a maximum amplitude of a magnetic field produced by the first unbalanced antenna element and a maximum amplitude of a magnetic field produced by the second balanced antenna element amplitude are in line with the second direction that is substantially perpendicular to the first direction.

6. An antenna as claimed in claim 5, wherein the first unbalanced antenna element comprises a first end, which is an open circuit, at one extremity of the first length and a second end, which is grounded, at another extremity of the first length, and the second balanced antenna element comprises a first end, which is an open circuit, at one extremity of the second length, a second end, which is an open circuit, at another extremity of the second length and a midpoint substantially half way between the first end and the second end, wherein the second end of the first unbalanced antenna element and the midpoint of the second balanced antenna element are substantially in line with the second direction that is substantially perpendicular to the first direction.

7. An antenna as claimed in claim 6, wherein a maximum amplitude of a magnetic field is produced by the first unbalanced antenna element at a second end thereof and a maximum amplitude of a magnetic field is produced by the second balanced antenna at the midpoint.

8. An antenna as claimed in claim 1, wherein the first unbalanced antenna element is a planar inverted-F antenna.

9. An antenna as claimed in claim 8, wherein the first unbalanced antenna element is a quarter wavelength planar inverted-F antenna.

10. An antenna as claimed in claim 1, wherein the second balanced antenna element is a patch antenna.

11. An antenna as claimed in claim 10, wherein the second balanced antenna element is a half-wavelength patch antenna.

12. A portable telephone comprising an antenna as claimed in claim 11.

13. A portable telephone as claimed in claim 12 comprising a cover comprising the second balanced antenna element.

14. A portable telephone as claimed in claim 12, wherein the first unbalanced antenna element is disposed on a circuit board housed within the portable telephone.

15. A portable telephone as claimed in claim 12, operable according to the WCDMA communication standard.

16. A portable telephone as claimed in claim 4 comprising a cover comprising the second balanced antenna element.

17. An antenna comprising:

a first element having a first length in a first direction and comprising a first end at one extremity of a length thereof, a second end at another extremity of the length thereof and a feed point wherein the first end is an open circuit and the second end is grounded;

a second element having a spaced relationship from the first element and a second length in the first direction and comprising a first end at one extremity of length thereof, a second end at another extremity of a length, wherein the first end is an open circuit and the second end is an open circuit; and wherein the first end of the first element and the first end of the second element are substantially in line with a second direction that is substantially perpendicular to the first direction.

18. An antenna as claimed in claim 17, wherein the first length corresponds to $\lambda/4$ at resonant frequency and the second length corresponds to $\lambda/2$ at resonant frequency.

19. An antenna element as claimed in claim 17, wherein the second balanced antenna element further comprises a midpoint substantially half way between the first end and the second end, wherein the second end of the first unbalanced antenna element and the midpoint of the second balanced antenna element are substantially in line with the second direction that is substantially perpendicular to the first direction.

20. An antenna as claimed in claim 17, wherein the first unbalanced antenna element is a planar inverted-F antenna.

21. An antenna as claimed in claim 20, wherein the first unbalanced antenna element is a quarter wavelength planar inverted-F antenna.

22. An antenna as claimed in claim 17, wherein the second balanced antenna element is a patch antenna.

23. An antenna as claimed in claim 22, wherein the second balanced antenna element is a half-wavelength patch antenna.

24. A portable telephone comprising an antenna as claimed in claim 17.

25. A portable telephone as claimed in claim 24, wherein the first unbalanced antenna element is disposed on a circuit board housed within the portable telephone.

26. A portable telephone as claimed in claim 24, operable according to the WCDMA communication standard.

27. An antenna as claimed in claim 17, wherein a maximum amplitude of an electric field produced by the first unbalanced antenna element and a maximum amplitude of an electric field produced by the second balanced antenna amplitude are in line with the second direction that is substantially perpendicular to the first direction.

28. An antenna as claimed in claim 17, wherein a maximum amplitude of an electric field is produced by the first unbalanced antenna element at a first end thereof and a maximum amplitude of an electric field is produced by the second balanced antenna element at the first end thereof and at a second end thereof.

29. An antenna as claimed in claim 17, wherein a maximum amplitude of a magnetic field produced by the first unbalanced antenna element and a maximum amplitude of a magnetic field produced by the second balanced antenna element amplitude are in line with the second direction that is substantially perpendicular to the first direction.

30. An antenna as claimed in claim 17, wherein a maximum amplitude of a magnetic field is produced by the first unbalanced antenna element at a second end thereof and a maximum amplitude of a magnetic field is produced by the second balanced antenna at the midpoint thereof.

31. An antenna comprising:

a ground plane;

a first element having a first length in a first direction and comprising a first end at one extremity of a length thereof, a second end at another extremity of a length thereof and a feed point wherein the first end is an open circuit and the second end is connected to a ground plane;

a second element having a spaced relationship from the first element and a second length in the first direction and comprising a first end at one extremity of a length thereof, a second end at another extremity of a length thereof, a midpoint substantially half way between the first end and the second end wherein the first end is an open circuit and the second end is an open circuit; and wherein the second end of the first element and the midpoint of the second element are substantially in line with a second direction that is substantially perpendicular to the first direction.

* * * * *